US011004413B2

(12) United States Patent
Ren et al.

(10) Patent No.: US 11,004,413 B2
(45) Date of Patent: May 11, 2021

(54) POWER CIRCUIT FOR DISPLAY PANEL, DISPLAY PANEL AND DRIVING METHOD THEREOF

(71) Applicants: Chongqing BOE Optoelectronics Technology Co., Ltd., Chongqing (CN); BOE TECHNOLOGY GROUP CO., LTD., Beijing (CN)

(72) Inventors: Yanfei Ren, Beijing (CN); Jingpeng Zhao, Beijing (CN); Panpan Li, Beijing (CN); Xuebo Liang, Beijing (CN); Ting Yang, Beijing (CN); Weixing Shan, Beijing (CN); Xiuzhu Tang, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/659,606

(22) Filed: Oct. 22, 2019

(65) Prior Publication Data

US 2020/0242990 A1 Jul. 30, 2020

(30) Foreign Application Priority Data

Jan. 29, 2019 (CN) ..... 201910088096.4

(51) Int. Cl.
*G09G 3/36* (2006.01)
*G09G 3/20* (2006.01)

(52) U.S. Cl.
CPC ..... *G09G 3/3655* (2013.01); *G09G 3/20* (2013.01); *G09G 2300/0426* (2013.01); *G09G 2300/08* (2013.01); *G09G 2310/0243* (2013.01); *G09G 2310/0275* (2013.01); *G09G 2310/0281* (2013.01); *G09G 2320/0233* (2013.01); *G09G 2320/0613* (2013.01); *G09G 2320/103* (2013.01); *G09G 2330/02* (2013.01)

(58) Field of Classification Search
CPC ..... G09G 3/3655; G09G 2320/0247; G09G 2320/103; G09G 3/3614; G09G 3/3648; G09G 3/3607; G09G 3/3611; G09G 2320/02; G09G 2320/0219; G02F 2201/121
See application file for complete search history.

(56) References Cited

U.S. PATENT DOCUMENTS

2002/0080109 A1* 6/2002 Nagata ..... G09G 3/3688 345/92
2008/0303770 A1* 12/2008 Oke ..... G09G 3/3655 345/92

(Continued)

*Primary Examiner* — Sanjiv D. Patel
(74) *Attorney, Agent, or Firm* — Calfee, Halter & Griswold LLP

(57) ABSTRACT

A power circuit of a display panel and a display panel. The power circuit comprises a sensing circuit and a voltage output circuit. The sensing circuit is configured to provide a sensing signal indicative of a type of an image to be displayed by the display panel. The voltage output circuit is electrically connected to common electrodes of the display panel and configured to receive the sensing signal and change potentials of some of the common electrodes in response to a change in the sensing signal.

9 Claims, 6 Drawing Sheets

(56) References Cited

U.S. PATENT DOCUMENTS

| | | | | |
|---|---|---|---|---|
| 2010/0245326 | A1* | 9/2010 | Xiao | G09G 3/3655 345/211 |
| 2012/0162184 | A1* | 6/2012 | Kim | G09G 3/3655 345/212 |
| 2014/0028535 | A1* | 1/2014 | Min | G09G 3/3655 345/87 |
| 2014/0085345 | A1* | 3/2014 | Ma | G09G 3/3696 345/690 |
| 2015/0185744 | A1* | 7/2015 | Lee | G05F 1/461 330/260 |
| 2015/0356951 | A1* | 12/2015 | Wang | G09G 5/18 345/213 |
| 2016/0365025 | A1* | 12/2016 | Ding | G09G 3/2092 |
| 2017/0061864 | A1* | 3/2017 | Tang | G09G 3/3655 |
| 2017/0206818 | A1* | 7/2017 | Wang | G09G 3/006 |

* cited by examiner

POWER CIRCUIT FOR DISPLAY PANEL, DISPLAY PANEL AND DRIVING METHOD THEREOF

CROSS REFERENCE TO RELATED APPLICATIONS

The present application claims the priority benefits of the patent application No. 201910088096.4 filed with the Patent Office of China on Jan. 29, 2019, the disclosure of which is incorporated herein by reference.

TECHNICAL FIELD

The disclosure relates to the field of display technologies, and in particular to a power circuit for a display panel, a display panel and a driving method thereof.

BACKGROUND

At present, display devices such as liquid crystal displays and OLED displays have been widely applied, and there is an increasingly higher requirement for the display devices themselves and the quality of images they display. For example, a thin and light display device with a narrow frame and low power consumption has always been desired, and images of high-quality not only mean high definition, but also uniformity of the images which has been gradually caused researchers' concern.

SUMMARY

Exemplary embodiments provide a power circuit of a display panel, the power circuit comprising a sensing circuit and a voltage output circuit. The sensing circuit is configured to provide a sensing signal, the sensing signal being indicative of a type of an image to be displayed by the display panel, the voltage output circuit is electrically connected to common electrodes of the display panel, and the voltage output circuit is configured to receive the sensing signal and change potentials of some of the common electrodes in response to a change in the sensing signal.

According to some exemplary embodiments, the sensing circuit comprises a current detecting circuit, and the current detecting circuit is configured to sense an operation current of the display panel, a change in the operation current reflecting a change in the type of the image to be displayed by the display panel.

According to some exemplary embodiments, the sensing circuit comprises a data signal pulse detecting circuit, and the data signal pulse detecting circuit is configured to detect a number of pulses of a data signal for the image to be displayed in a unit time period.

According to some exemplary embodiments, the current detecting circuit comprises a comparison circuit, and the comparison circuit is configured to compare the operation current with a reference current to generate the sensing signal.

According to some exemplary embodiments, the comparison circuit comprises a comparator, an input terminal of the comparator is configured to receive an internal DC operation voltage of the display panel, a second terminal of the comparator is electrically connected to a reference voltage terminal, and an output terminal of the comparator is electrically connected to the first input terminal and configured to output the sensing signal.

According to some exemplary embodiments, the voltage output circuit comprises a first voltage output sub-circuit and a second voltage output sub-circuit, the first voltage output sub-circuit is configured to output a first voltage in response to receipt of the sensing signal of a first level, and the second voltage output sub-circuit is configured to output a second voltage different from the first voltage in response to receipt of the sensing signal of a second level.

According to some exemplary embodiments, the first voltage output sub-circuit comprises a first transistor, a control terminal of the first transistor is electrically connected to the output terminal of the sensing circuit to receive the sensing signal, a first terminal of the first transistor is electrically connected to a first voltage terminal, the first voltage terminal is configured to provide the first voltage, and a second terminal of the first transistor is configured to output the first voltage. The second voltage output sub-circuit comprises a second transistor, a control terminal of the second transistor is electrically connected to the output terminal of the sensing circuit to receive the sensing signal, a first terminal of the second transistor is electrically connected to a second voltage terminal, the second voltage terminal is configured to provide the second voltage, and a second terminal of the second transistor is configured to output the second voltage.

According to some exemplary embodiments, the first transistor comprises one of an N-type transistor and a P-type transistor, and the second transistor comprises the other of the N-type transistor and the P-type transistor.

Another exemplary embodiment provides a display panel, the display panel comprises: a plurality of common electrodes in a display area of the display panel, the display area at least comprising a first sub-display area and a second sub-display area, and a power circuit configured to drive the plurality of common electrodes. The plurality of common electrodes at least comprise a first common electrode in the first sub-display area and a second common electrode in the second sub-display area, the first common electrode and the second common electrode are insulated from each other. The power circuit comprises a sensing circuit and a voltage output circuit, the sensing circuit is configured to provide a sensing signal, the sensing signal being indicative of a type of an image to be displayed by the display panel. The voltage output circuit is electrically connected to one of the first common electrode and the second common electrode, the voltage output circuit is configured to receive the sensing signal and change a potential of the one of the first common electrode and the second common electrode in response to a change in the sensing signal.

According to some exemplary embodiments, the display panel further comprises a plurality of data lines and a source driver in a non-display area of the display panel, the plurality of data lines comprise a first data line extending from the source driver to the first sub-display area and a second data line extending from the source driver to the second sub-display area, a length of the first data line is different from a length of the second data line, and the first sub-display area and the second sub-display area are arranged in a direction perpendicular to an extending direction of the plurality of data lines in the display area.

According to some exemplary embodiments, the source driver is located in a central part of an edge of the display panel, and the first sub-display area comprises a central area of the display area, lines from the first common electrode in the central area to the central part of the edge are substantially perpendicular to the edge.

According to some exemplary embodiments, the voltage output circuit comprises a first voltage output sub-circuit and a second voltage output sub-circuit, the first voltage output sub-circuit is configured to output a first voltage in response to receipt of the sensing signal of a first level, and the second voltage output sub-circuit is configured to output a second voltage different from the first voltage in response to receipt of the sensing signal of a second level, one of the first common electrode and the second common electrode is electrically connected with the first voltage output sub-circuit and the second voltage output sub-circuit to receive the first voltage or the second voltage, and the other of the first common electrode and the second common electrode is configured to be electrically connected to a fixed potential terminal having the first voltage or the second voltage.

According to some exemplary embodiments, the sensing circuit comprises a current detecting circuit, and the current detecting circuit is configured to sense an operation current of the display panel, a change in the operation current reflecting a change in the type of the image to be displayed by the display panel.

According to some exemplary embodiments, the sensing circuit comprises a data signal pulse detecting circuit, and the data signal pulse detecting circuit is configured to detect a number of pulses of a data signal for the image to be displayed in a unit time period.

According to some exemplary embodiments, the current detecting circuit comprises a comparison circuit, the comparison circuit is configured to compare the operation current with a reference current to generate the sensing signal.

According to some exemplary embodiments, the comparison circuit comprises a comparator, an input terminal of the comparator is configured to receive an internal DC operation voltage of the display panel, a second terminal of the comparator is electrically connected to a reference voltage terminal, and an output terminal of the comparator is electrically connected to the first input terminal and configured to output the sensing signal.

Yet another exemplary embodiment provides a method for driving a display panel, the display panel comprising a plurality of common electrodes in a display area, the display area at least comprising a first sub-display area and a second sub-display area, the plurality of common electrodes at least comprising a first common electrode in the first sub-display area and a second common electrode in the second sub-display area, the first common electrode and the second common electrode being insulated from each other. The method comprises: sensing a type of an image to be displayed by the display panel, and changing a potential of one of the first common electrode and the second common electrode in response to a change in the type of the image to be displayed.

According to some exemplary embodiments, the image to be displayed comprises a first type image and a second type image, a number of pulses within an unit time period of a first data signal for displaying the first type image is not greater than a first threshold, and a number of pulses within the unit time period of a second data signal for displaying the second type image is greater than the first threshold. The method comprises providing a same potential to the first common electrode and the second common electrode in response to the display panel displaying the first type image, and changing the potential of the one of the first common electrode and the second common electrode in response to the display panel displaying the second type image.

BRIEF DESCRIPTION OF DRAWINGS

In order to illustrate the technical solutions in the exemplary embodiments more clearly, drawings to be used in depictions of the exemplary embodiments will be briefly introduced below. The drawings in the included figures are only some embodiments of the disclosure. For a person having ordinary skill in the art, other drawings can be further obtained from these drawings without any inventive efforts.

DETAILED DESCRIPTION

Figure 1:
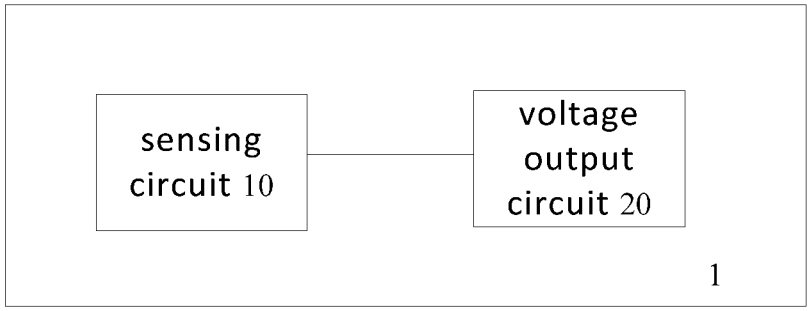
FIG. 1 is a structural diagram of the power circuit of the display panel according to an exemplary embodiment.

The technical solutions in the exemplary embodiments will be described clearly and completely with reference to the drawings related to the exemplary embodiments. The described embodiments are only part of possible embodiments of the disclosure. Based on the exemplary embodiments herein, all other embodiments obtainable for a person having ordinary skills in the art without any inventive efforts shall fall within the scope of the present application.

In the description of the disclosure, it should be understood that "a plurality of" means two or more.

In order to further reduce the size of the frame of the display panel, a TED (TCON embedded driver)-based IC technique is proposed, and specifically, a timer control register (TCON) and a data driving circuit (also called a source driver) are integrated into one chip so as to achieve a super-narrow frame and low power consumption of the display panel. However, for a display panel of this type, the quality of image displayed is not improved. Especially, in case of the display panel of a large size, it tends to happen that the displayed image has an uneven brightness.

The chip including the source driver and the TCON is usually fixed in a non-display area on a side of the display panel. The inventors of the present application have realized that data lines led out from the source driver and extending in the display area of the display panel have different lengths. For example, for display areas close to the source driver, the data lines can substantially be straight, or only need to bend a little to reach these display areas after being led out from the source driver. However, for pixel regions far from the source driver, the data lines have to bend a lot in order to reach the display areas after being led out from the source driver. Besides, as the size of the display panel increases, the difference in the lengths of the data lines also increases.

The inventors of the application have further realized that the difference in the lengths of the data lines corresponding to different display areas is a major reason for brightness unevenness of the image displayed by the display panel. For example, if the chip including the source driver is arranged in a middle position on a side of the display panel, the lengths of data lines distributed on both sides of the chip will be greater than the lengths of data lines that are located in the middle display area of the display panel and corresponding to the chip position. This would result in that, for a same gray scale voltage, the voltage actually applied to the pixel electrodes located in the display areas on both sides of the chip will be smaller than the voltage applied to the pixel electrodes located in the middle display area of the display panel. However, for a conventional display panel, a common voltage for each pixel is the same, and as a result, the voltage differences between the pixel electrodes of different display areas of the display panel and the common electrodes differ considerably, which leads to brightness unevenness of the display image.

An exemplary embodiment provides a power circuit of a display panel so as to mitigate or alleviate the brightness unevenness in images displayed by the display panel. According to an exemplary embodiment, as shown in FIG. 1, the power circuit 1 comprises a sensing circuit 10 and a voltage output circuit 20. The sensing circuit 10 is configured to provide a sensing signal, the sensing signal being indicative of a type of an image to be displayed by the display panel. The voltage output circuit 20 is electrically connected to common electrodes of the display panel and configured to receive the sensing signal and change potentials of some of the common electrodes in response to a change in the sensing signal.

Figure 2:
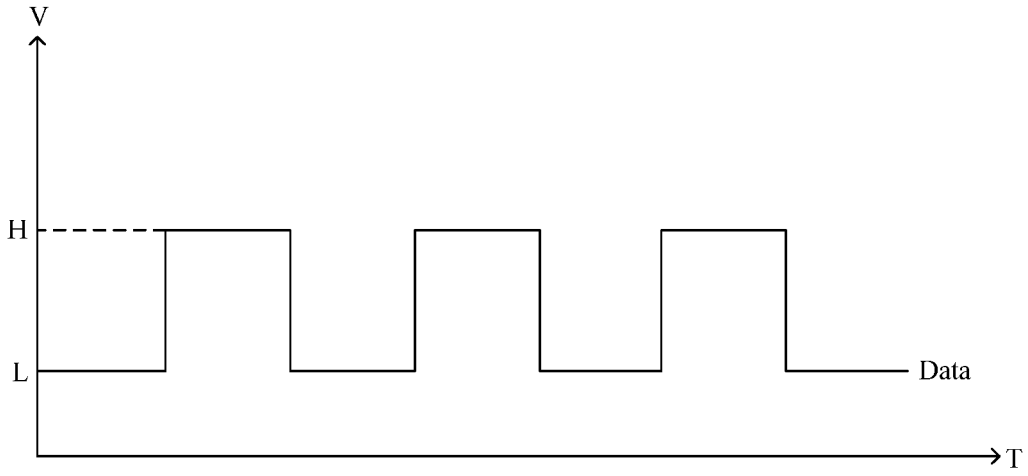
FIG. 2 shows a voltage waveform of a data signal for an image.

Through research, the inventors of the application have further found that the phenomenon of brightness unevenness is also associated with the image displayed by the display device. Specifically, the brightness unevenness is more distinct when a heavy load image is displayed, and less perceptible for human eyes when a light load image is displayed. Therefore, the type of the image to be displayed by the display panel mentioned herein comprises a heavy load image and a light load image. The difference between the heavy load image and the light load image may also be embodied in data signals for the image to be displayed. FIG. 2 schematically shows the voltage waveform of the data signals, where "V" represents a voltage of the data signals (i.e., data voltage), "T" represents time, "H" represents a high level and "L" represents a low level. Regarding data signals for a heavy load image, the data voltage frequently switches between the high level and the low level, which would cause several contiguous rows of sub-pixels frequently switch between a low brightness and a high brightness, so the source driver is in a high load state, the brightness unevenness in the image displayed by the display panel is apt to occur. As to data signals for a light load image, the data voltage switches between the high level and the low level less frequently such that the source driver is in a low load state, which does not easily lead to significant brightness unevenness.

The power circuit provided in the exemplary embodiment can adjust the potential of the common electrodes of the display panel according to the type of the image to be displayed by the display panel. Specifically, the power circuit is capable of changing the potentials of some of the common electrodes in response to a change in the type of the image to be displayed, i.e., different sub-display areas of the display area of the display panel can have different common potentials such that the voltage differences between the pixel electrodes of different sub-display areas and the common electrodes generally tend to be consistent, which mitigates or alleviates the problem of brightness unevenness. In the following, the power circuit will be further described in detail by examples.

The sensing circuit in the power circuit may be implemented in different ways, and the specific embodiments of the sensing circuit will not be limited in the disclosure. According to some exemplary embodiments, the sensing circuit comprises a current detecting circuit, the current detecting circuit being configured to sense an operation current of the display panel, and changes in the operation current reflecting changes in the type of the image to be displayed by the display panel. As mentioned above, when the display panel displays a heavy load image, the source driver is in a heavy load state, so the operation current of the display panel in this case would be greater than the operation current when the display panel displays a light load image. Hence, by detecting changes in the operation current of the display panel, it can be judged whether the type of the image to be displayed by the display panel has changed. For example, a threshold current can be set, and if a sensed operation current exceeds the threshold current, it indicates that the type of the image to be displayed is a heavy load image; otherwise, it indicates that the type of the image to be displayed is a light load image. The operation current of the display panel mentioned above may be a current in a voltage loop providing electric power to the chip including the source driver inside the display panel, or a current in a voltage loop providing electric power to the entire display panel. It can be understood that the operation current may be either a DC current or an AC current depending on which position of the circuit structure of the display panel is sensed to obtain the operation current. The current detecting circuit may be implemented as a current sensor.

Alternatively, according to a further exemplary embodiment, the sensing circuit may be implemented as comprising a data signal pulse detecting circuit, the data signal pulse detecting circuit being configured to detect a number of pulses of data signals for the image to be displayed in a unit time period. Referring back to FIG. 2, the signals of the data voltage typically appear as a pulse waveform transitioning between a high level "H" and a low level "L". As discussed above, the difference between a heavy load image and a light load image can be reflected in data signals as the difference in the frequencies of the data voltage switching between the high level and the low level, and for the data signals of the heavy load image, the frequency of the data voltage switching between the high level and the low level is obviously higher. Therefore, it can be understood that for the waveform of data signals for the heavy load image, there are more pulses in a unit time period. In this way, the type of the image to be displayed can be determined by detecting the number of pulses of the data signals for the image to be displayed in a unit time period. For example, a threshold number of pulses can be set, and when the number of pulses of the data signals of the image to be displayed in a unit time period is detected to exceed the threshold number of pulses, the image to be displayed is determined as a heavy load image; otherwise, it is determined as a light load image.

Some exemplary embodiments of the sensing circuit in the power circuit have been discussed, based on the characteristics of the heavy load image and the light load image described herein, the person of ordinary skill in the art can conceive and implement sensing circuits of other forms, so the implementations of the sensing circuit in the power circuit sought for protection in the application is not limited to the above examples.

According to some exemplary embodiments, the current detecting circuit in the sensing circuit comprises a comparison circuit, the comparison circuit being configured to compare the operation current with a reference current to generate the sensing signal. In some exemplary embodiments, the comparison circuit comprises a comparator, a first input terminal of the comparator being configured to receive an internal DC operation voltage of the display panel, a second terminal of the comparator being electrically connected to a reference voltage terminal, and an output terminal of the comparator being electrically connected to the first input terminal and configured to output the sensing signal. The voltage output circuit of the power circuit may comprise a first voltage output sub-circuit and a second voltage output sub-circuit, the first voltage output sub-circuit being configured to output a first voltage in response to receipt of the sensing signal of a first level, and the second voltage output sub-circuit being configured to output a second voltage different from the first voltage in response to receipt of the sensing signal of a second level.

Figure 3:
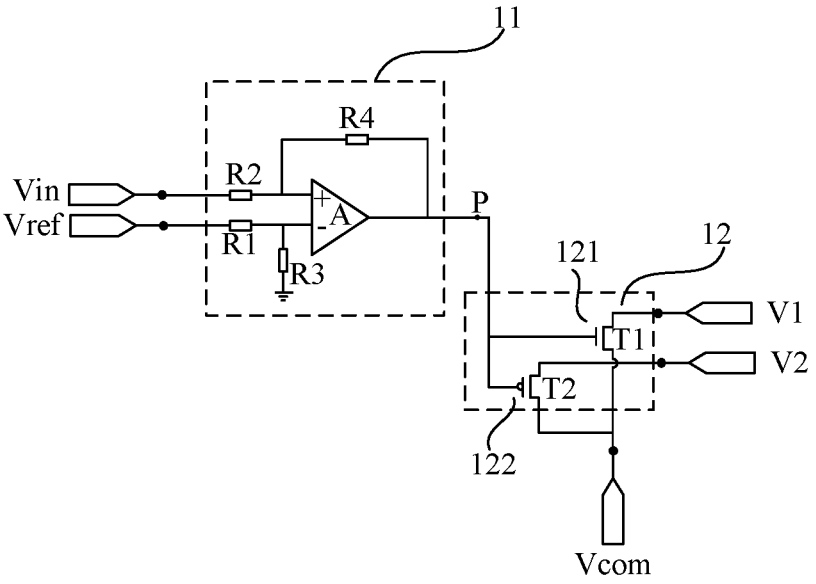
FIG. 3 is a circuit diagram of main components of the power circuit of the display panel according to an exemplary embodiment.

FIG. 3 schematically shows a diagram of the sensing circuit and the voltage output circuit according to an exemplary embodiment.

With reference to FIG. 3, in this exemplary embodiment, the sensing circuit comprises a current detecting circuit 11, the circuit detecting circuit 11 is electrically connected with the voltage output circuit 12. The current detecting circuit 11 may be electrically connected with an input terminal Vin of a power management IC (PMIC) in the display panel, and the current detecting circuit 11 is configured to output a sensing signal of a first level to a first node P when a current of the input terminal Vin of the PMIC is greater than a current provided by a reference voltage terminal Vref, and output a sensing signal of a second level to the first node P when the current of the input terminal Vin of the PMIC is smaller than the current provided by the reference voltage terminal Vref. The voltage output circuit 12 is connected with the first node P, a first voltage terminal V1, a second voltage terminal V2 and a voltage output terminal Vcom. The voltage output circuit 12 is configured to output a first voltage provided by the first voltage terminal V1 to the voltage output terminal Vcom under the control of the sensing signal of the first level of the first node P, and output a second voltage provided by the second voltage terminal V2 to the voltage output terminal Vcom under the control of the sensing signal of the second level of the first node P.

As shown in FIG. 3, the voltage output circuit 12 comprises a first voltage output sub-circuit 121 and a second voltage output sub-circuit 122. The first voltage output sub-circuit 121 is connected with the first node P, the first voltage terminal V1 and the voltage output terminal Vcom and configured to output a first voltage from the first voltage terminal V1 to the voltage output terminal Vcom under the control of the sensing signal of the first level of the first node P. The second voltage output sub-circuit 122 is connected with the first node P, the second voltage terminal V2 and the voltage output terminal Vcom and configured to output a second voltage from the second voltage terminal V2 to the voltage output terminal Vcom under the control of the sensing signal of the second level of the first node P. That is, the first voltage output sub-circuit 121 is switched on in response to receipt of the sensing signal of the first level and switched off in response to receipt of the sensing signal of the second level, thereby providing the first voltage from the first voltage terminal V1 to the voltage output terminal Vcom; the second voltage output sub-circuit 122 is switched on in response to receipt of the sensing signal of the second level and switched off in response to receipt of the sensing signal of the first level, thereby providing the second voltage from the second voltage terminal V2 to the voltage output terminal Vcom.

In an exemplary embodiment, the first voltage output sub-circuit 121 comprises a first transistor T1, a gate thereof being connected with the first node P, a first terminal thereof being connected with the first voltage terminal V1, and a second terminal thereof being connected with the voltage output terminal Vcom. The second voltage output sub-circuit 122 comprises a second transistor T2, a gate thereof being connected with the first node P, a first terminal thereof being connected with the second voltage terminal V2, and a second terminal thereof being connected with the voltage output terminal Vcom.

Figure 4:
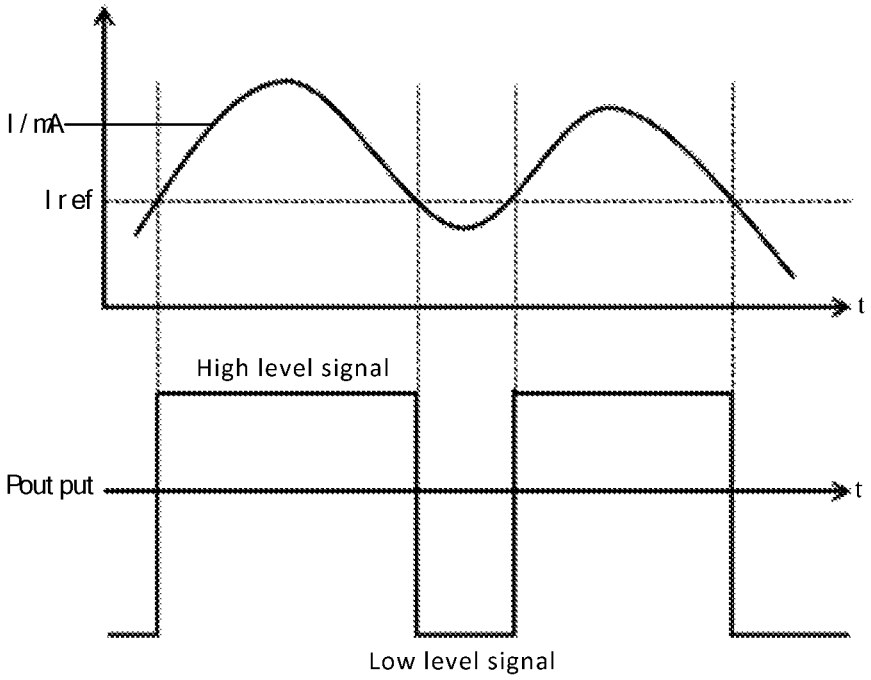
FIG. 4 schematically shows changes in the output signal of the current detecting circuit of the power circuit shown in FIG. 3.

In an exemplary embodiment, the first transistor T1 may be an N-type transistor and the second transistor T2 may be a P-type transistor. Alternatively, the first transistor T1 may be a P-type transistor and the second transistor T2 may be an N-type transistor. FIG. 4 illustrates the voltage output circuit by taking an example where the first transistor T1 is an N-type transistor and the second transistor T2 is a P-type transistor. According to the operation principle of N-type transistors and P-type transistors, when the gate voltage of the first transistor T1 is greater than the source voltage, the first transistor T1 is switched on and the second transistor T2 is switched off, so the first voltage of the first voltage terminal V1 is provided to the voltage output terminal Vcom. When the gate voltage of the second transistor T2 is smaller than the source voltage thereof, the second transistor T2 is switched on and the first transistor T1 is switched off, so the second voltage of the second voltage terminal V2 is provided to the voltage output terminal Vcom. In some exemplary embodiments, both the first transistor T1 and the second transistor T2 are thin film transistors (TFTs). The first terminal of the first transistor T1 may be a source and the second terminal thereof may be a drain, and the first terminal of the second transistor may be a source and the second terminal thereof may be a drain. According to a further exemplary embodiment, the first transistor T1 is an N-metal oxide semiconductor (NMOS) field effect transistor, and the second transistor T2 is a P-metal oxide semiconductor (PMOS) field effect transistor. Generally, the source and the drain of a MOS transistor can be exchanged, such a device is considered as symmetrical. An NMOS transistor will be switched on when the gate-source voltage is greater than a certain value, and correspondingly in an exemplary embodiment, the NMOS transistor is switched on when the difference between the voltage at the first node P and the voltage of the first voltage terminal V1 is greater than a certain value. A PMOS transistor will be switched on when the gate-source voltage is smaller than a certain value, and correspondingly in an exemplary embodiment, the PMOS transistor is switched on when the difference between the voltage at the first node P and the voltage of the second voltage terminal V2 is smaller than a certain value.

According to an exemplary embodiment, as shown in FIG. 3, the current detecting circuit 11 comprises a comparator A, a first resistor R1, a second resistor R2, a third resistor R3 and a fourth resistor R4. One end of the first transistor R1 is connected with the reference voltage terminal Vref, and the other end thereof is connected with a negative input terminal of the comparator A. One end of the second transistor R2 is connected with an input terminal Vin of the PMIC, and the other end thereof is connected with a positive input terminal of the comparator A. One end of the third transistor R3 is connected with the negative input terminal of the comparator A, and the other end thereof is grounded. One end of the fourth transistor R4 is connected with the positive input terminal of the comparator A, and the other end is connected with an output terminal of the comparator, the output terminal of the comparator A is connected with the first node P.

With reference to FIG. 3 and FIG. 4, a current I of the input terminal Vin of the PMIC is converted into a voltage signal via the second transistor R2 and provided to the positive input terminal of the comparator A, and a current Iref provided by the reference voltage terminal Vref is converted into a reference voltage signal via the first transistor R1 and provided to the negative input terminal of the comparator A, and the comparator A compares the voltage signals at the positive input terminal and the negative input terminal, outputs a high level signal or a low level signal (i.e., a sensing signal of a first level or a second level) to the first node P, and controls the first voltage output sub-circuit and the second voltage output sub-circuit. With reference to FIG. 4, when the current I of the input terminal Vin of the PMIC is greater than the current Iref provided by the reference voltage terminal Vref, a sensing signal of a high level is outputted to the first node P, and when the current I of the input terminal Vin of the PMIC is smaller than the current Iref provided by the reference voltage terminal Vref, a sensing signal of a low level is outputted to the first node P. In an example, the level of the sensing signal of the high level may be 8V, and the level of the sensing signal of the low level may be −8V.

Figure 5:
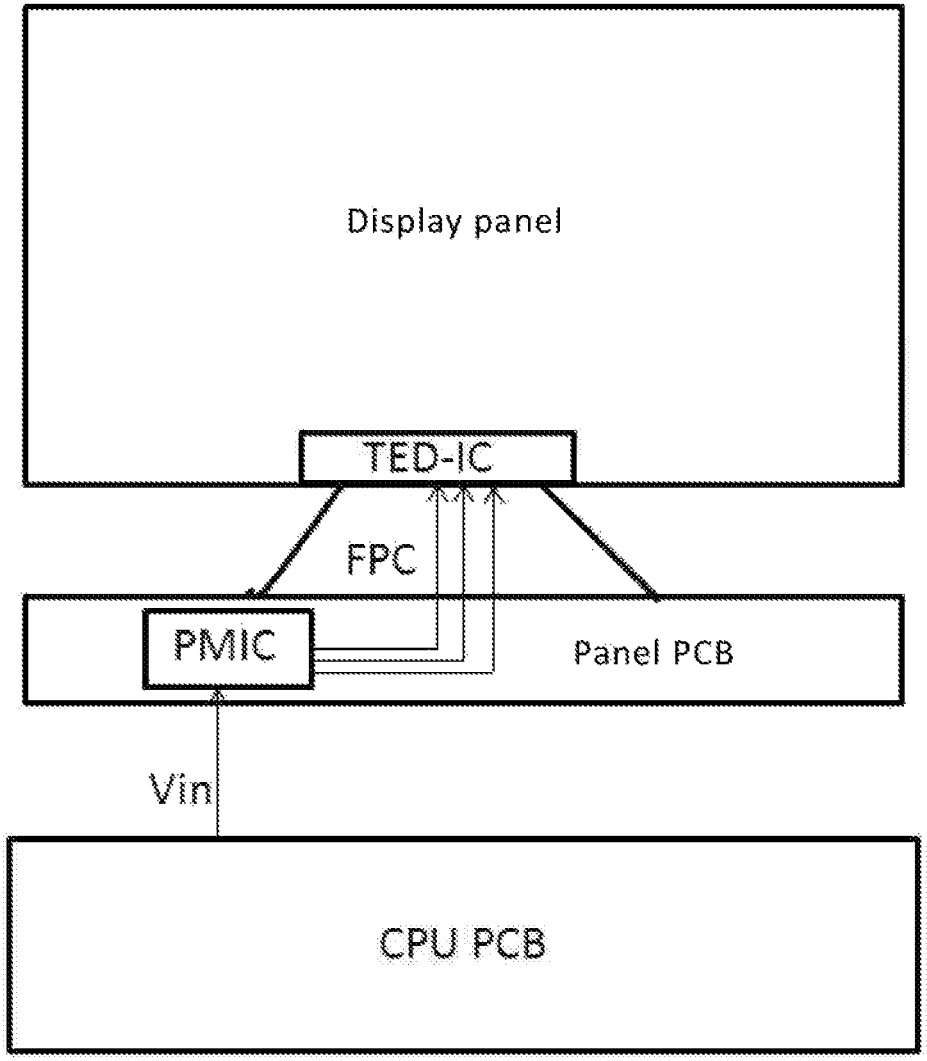
FIG. 5 is an example of an exploded view of part of the display panel according to an exemplary embodiment.

FIG. 5 schematically shows a part exploded view of a display device based on TCON embedded driver (TED)-IC according to an exemplary embodiment. The display device includes a display panel, a system board (CPU PCB), a panel printed circuit board (PCB), a flexible printed circuit (FPC), a power management IC (PMIC) and so on. The display panel is provided with common electrodes in a display area and a TED-IC in a non-display area, and the TED-IC is arranged in a middle position of a lower edge of the display panel, and the non-display area is further provided with a gate driving circuit or the like. A TCON and a source driver are integrated in the TED-IC. The PMIC is arranged on the panel PCB and connected with the TED-IC via the FPC. The system board provides a constant voltage (e.g., 3.3V) to the PMIC, and the PMIC can provide corresponding voltages to the TED-IC, the common electrodes the gate driving circuit and so on. In case the loads of the TCON, the common electrodes and the gate driving circuit all remain unchanged, the current of the input terminal of the PMIC will increase as the power consumption of the source driver increases. That is, when a heavy load image is displayed, the current of the input terminal of the PMIC is far greater than when a non-heavy load image is displayed. Therefore, by detecting the current of the input terminal of the PMIC, it can be judged whether the image to be displayed is a heavy load image or a light load image, and the potentials of the common electrodes would be controlled based on the judgement.

A further exemplary embodiment provides a display panel, and the principle of the power circuit provided in the above exemplary embodiments capable of mitigating or alleviating the brightness unevenness of the image displayed by the display panel will be further illustrated with reference to exemplary embodiments of the display panel.

The display panel provided according to an exemplary embodiment comprises a display area and a non-display area, the display area at least comprising a first sub-display area and a second sub-display area. The display panel comprises a plurality of common electrodes located in the display area of the display panel, and a power circuit configured to drive the plurality of common electrodes. The plurality of common electrodes at least comprise a first common electrode in the first sub-display area and a second common electrode in the second sub-display area, the first common electrode and the second common electrode being insulated from each other. The power circuit comprises a sensing circuit and a voltage output circuit, the sensing circuit is configured to provide a sensing signal indicative of a type of an image to be displayed by the display panel, the voltage output circuit is electrically connected to one of the first common electrode and the second common electrode and configured to receive the sensing signal and change a potential of the one of the first common electrode and the second common electrode in response to a change in the sensing signal.

Figure 6:
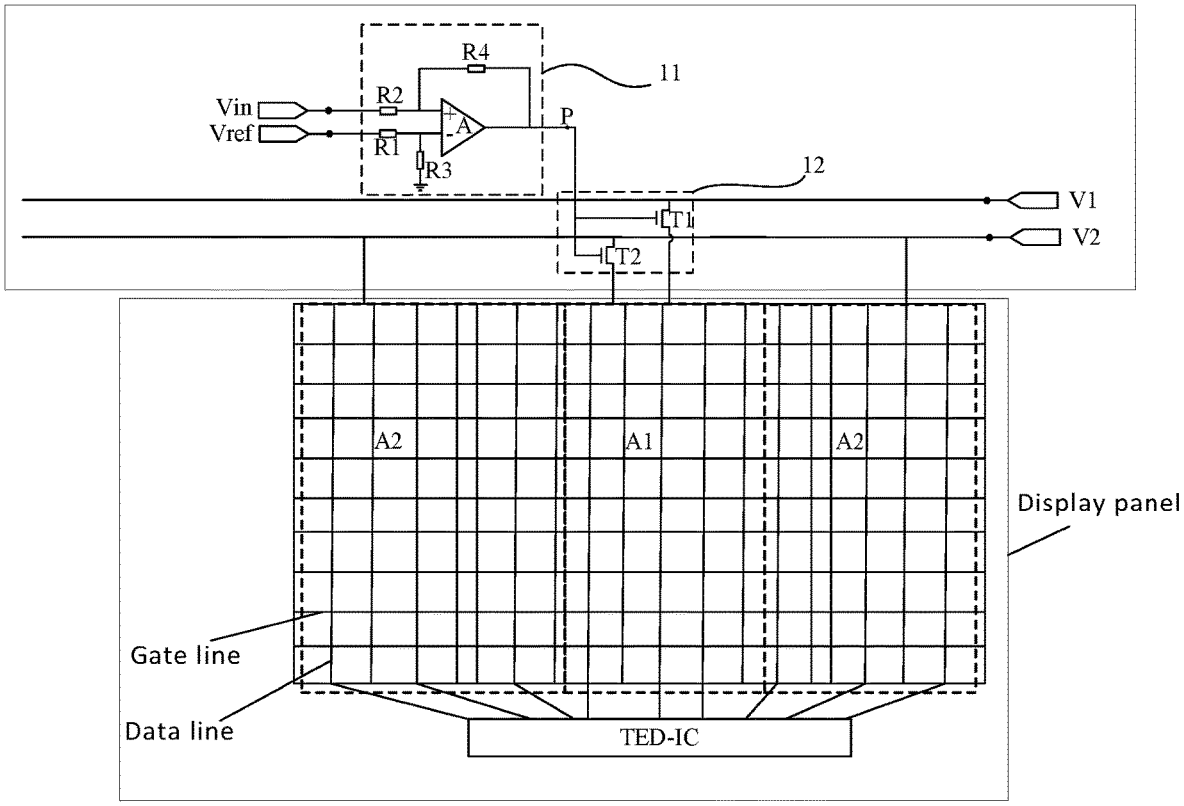
FIG. 6 is an example showing electrical connections between the power circuit and the common electrodes in the display panel according to an exemplary embodiment.

FIG. 6 schematically shows part structures of the display panel according to an exemplary embodiment. The display area of the display panel comprises a first sub-display area A1 and a second sub-display area A2, the first common electrode in the first sub-display area A1 and the second common electrode in the second sub-display area A2 are insulated from each other. In FIG. 6, one first sub-display area A1 and two second sub-display areas A2 are shown schematically by dashed blocks. The display panel comprises a TED-IC (comprising a source driver) located in the non-display area, and the TED-IC is arranged in a middle position of one side of the non-display area of the display panel. The first sub-display area A1 is located right above the TED-IC, and the second sub-display areas A2 are located on both sides of the first sub-display area A1. The first common electrode in the first sub-display area A1 is electrically connected with the power circuit.

Figure 8:
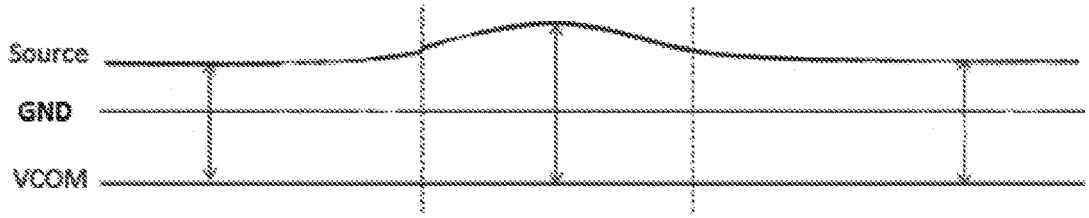
FIG. 8 illustrates that a voltage difference between the pixel voltage in the central sub-display area and the common potential and a voltage difference between the pixel voltage in the sub-display areas on either side of the central sub-display area and the common potential differ significantly in case of the display panel shown in FIG. 6 displaying a heavy load image, given that all common electrodes in the display panel shown receive a same common potential.

For the case where the TED-IC is arranged in the middle position of one side of the non-display area of the display panel, a data line extending from the source driver to the second sub-display area A2 is obviously longer than a data line extending to the first sub-display area A1, accordingly, for the source driver, the load in the second sub-display area A2 is greater than that in the first sub-display area A1 Therefore, with the same gray scale voltage, the pixel voltage actually applied to the pixel electrodes located in the second sub-display areas A2 will be smaller than the pixel voltage applied to the pixel electrodes located in the first sub-display area A1, as shown in FIG. 8. If the common electrodes of the entire display panel are all at a same common potential, the voltage difference between the pixel electrodes in the first sub-display area A1 and the common electrodes and the voltage difference between the pixel electrodes in the second sub-display area A2 and the common electrodes will differ considerably, which leads to brightness unevenness in the displayed image.

Figure 9:
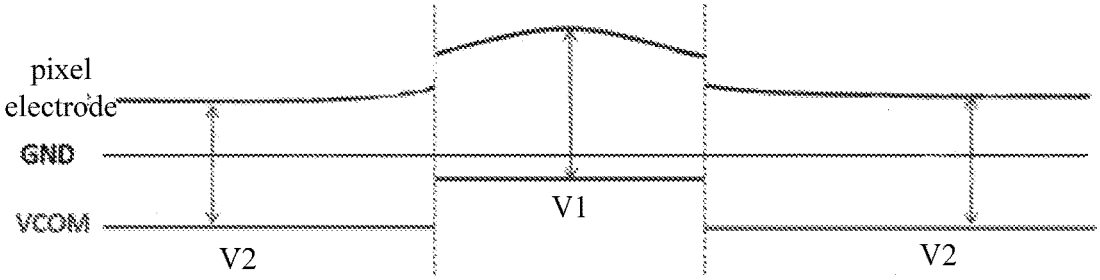
FIG. 9 illustrates that the difference in the voltage differences between the pixel voltage of the central sub-display area and the common potential and between the pixel voltage of the sub-display areas on either side of the central sub-display area and the common potential is reduced.

As for the exemplary embodiment shown in FIG. 6, the first common electrode in the first sub-display area A1 and the second common electrode in the second sub-display area A2 are insulated from each other, and the power circuit 1 in the display panel is electrically connected with the first common electrode in the first sub-display area A1 so as to adjust the potential of the first common electrode. In FIG. 6, the second common electrodes in the second sub-display area A2 are electrically connected to the second potential terminal V2, and in an exemplary embodiment, the first voltage provided by the first potential terminal is greater than the second voltage provided by the second potential terminal. When the sensing signal (the voltage signal at the node P) provided by the sensing circuit in the power circuit 1 indicates that the image to be displayed is a light load image, the voltage output circuit in the power circuit 1 provides the second voltage to the first common electrode in the first sub-display area A1, and hence the first common electrode has the same potential (i.e. the second voltage) as the second common electrode in the second sub-display area A2. When the voltage signal at the node P indicates that the image to be displayed is a heavy load image, the pixel voltage of the pixel electrodes in the first sub-display area A1 is higher than that of the pixel electrodes in the second sub-display area A2, the voltage output circuit in the power circuit 1 provides the first voltage of the first potential terminal (the first voltage is greater than the second voltage) to the first common electrode. In this way, the voltage difference between the pixel electrodes in the first sub-display area A1 and the common electrodes is reduced, as shown in FIG. 9. Accordingly, the voltage difference between the pixel electrodes in the first sub-display area A1 and the common electrodes and the voltage difference between the pixel electrodes in the second sub-display area A2 and the common electrodes tend to be consistent, or the difference between the above two voltage differences can at least be reduced, which mitigates or alleviates the brightness unevenness when a heavy load image is displayed.

The example of FIG. 6 further shows a plurality of gate lines and a plurality of data lines in the display panel. The plurality of data lines comprises a first data line led out from the source driver and extending into the first sub-display area A1 and a second data line led out from the source driver and extending into the second sub-display area A2. As mentioned above, a length of the first data line is different from that of the second data line. Moreover, the first sub-display area A1 and the second sub-display area A2 are arranged in a direction perpendicular to an extending direction of the plurality of data lines in the display area.

In the example of FIG. 6, the TED-IC comprising the source driver is located in a central part of an edge of the display panel, and the first sub-display area A1 comprises a central area of the display area, lines from the first common electrode in the central area to the central part are substantially perpendicular to the edge.

Figure 7:
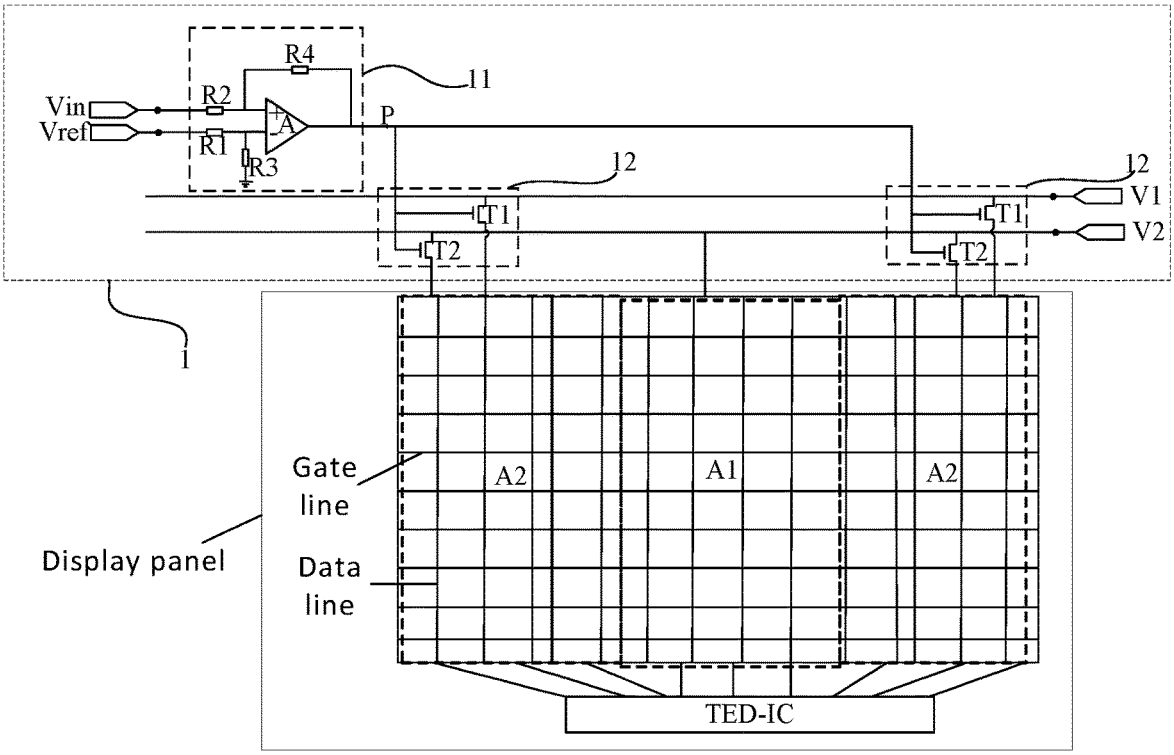
FIG. 7 is an example showing electrical connections between the power circuit and the common electrodes in the display panel according to another exemplary embodiment.

FIG. 7 schematically shows the display panel according to another exemplary embodiment, and FIG. 7 mainly shows that the electrical connections between the power circuit 1 in the display panel and the common electrodes in the display panel are different from those in the example of FIG. 6, but other structures of the display panel are similar to those in the example of FIG. 6. As shown in FIG. 7, the first common electrode in the first sub-display area A1 of the display panel is electrically connected with the second voltage terminal V2 so as to receive a fixed potential (the second voltage). The second common electrode in the second sub-display area A2 of the display panel is electrically connected with the power circuit 1 such that it can receive the first voltage or the second voltage provided by the power circuit 1. In this embodiment, the first voltage from the first voltage terminal V1 may be arranged to be smaller than the second voltage provided by the second voltage terminal V2. When the sensing signal provided by the sensing circuit in the power circuit 1 indicates that the image to be displayed is a light load image, the voltage output circuit 12 in the power circuit may output the second voltage and provide the second voltage to the second common electrode in the second sub-display area A2, in this case, the first common electrode in the first sub-display area A1 is also electrically connected to the second voltage terminal V2, so the first common electrode and the second common electrode have substantially the same potential. When the sensing signal provided by the sensing circuit in the power circuit 1 indicates that the image to be displayed is a heavy load image, as mentioned above, the pixel voltage of the pixel electrodes in the second sub-display area A2 is significantly lower than that of the pixel electrodes in the first sub-display area A1, and the voltage output circuit in the power circuit 1 provides the first voltage (the first voltage is smaller than the second voltage) to the second common electrode, therefore, it is possible that the voltage difference between the pixel electrodes in the first sub-display area A1 and the common electrodes and the voltage difference between the pixel electrodes in the second sub-display area A2 and the common electrodes tend to be consistent, or the difference between the above two voltage differences can at least be reduced, which mitigates or alleviates the brightness unevenness in the heavy load image displayed by the display panel.

For the example shown in FIG. 6 or FIG. 7, the voltage output circuit in the power circuit of the display panel comprises a first voltage output sub-circuit and a second voltage output sub-circuit, the first voltage output sub-circuit being configured to output a first voltage in response to receipt of the sensing signal of a first level, and the second voltage output sub-circuit being configured to output a second voltage different from the first voltage in response to receipt of the sensing signal of a second level. One of the first common electrode in the first sub-display area A1 and the second common electrode in the second sub-display area A2 is electrically connected with the first voltage output sub-circuit and the second voltage output sub-circuit so as to receive the first voltage or the second voltage, and the other one of the first common electrode and the second common electrode is configured to be electrically connected to a fixed potential terminal having the first voltage or the second voltage.

The type of the display panel mentioned above is not limited herein, and the display panel comprises but is not limited to a liquid crystal display panel, an OLED display panel, etc.

Figure 10:
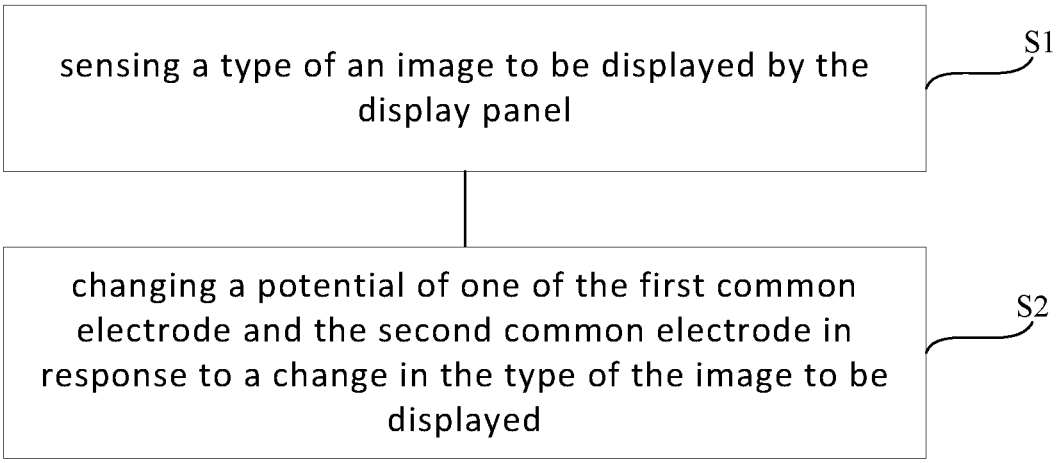
FIG. 10 shows a method for driving a display panel according to an exemplary embodiment.

Yet another exemplary embodiment provide a method for driving a display panel, the display panel comprises a plurality of common electrodes located in a display area, the display area at least comprising a first sub-display area and a second sub-display area; the plurality of common electrodes at least comprising a first common electrode located in the first sub-display area and a second common electrode located in the second sub-display area, the first common electrode and the second common electrode being insulated from each other. As shown in FIG. 10, the method comprises: S1, sensing a type of an image to be displayed by the display panel; S2, changing a potential of one of the first common electrode and the second common electrode in response to a change in the type of the image to be displayed.

In some exemplary embodiments, the image to be displayed comprises a first type image and a second type image. The number of pulses within an unit time period of a first data signal for displaying the first type image is not greater than a first threshold, and the number of pulses within the unit time period of a second data signal for displaying the second type image is greater than the first threshold, the method may comprise: providing a same potential to the first common electrode and the second common electrode in response to the display panel displaying the first type image; changing a potential of one of the first common electrode and the second common electrode in response to the display panel displaying the second type image.

It can be understood that the first type image defined herein may correspond to the light load image described in the foregoing embodiments, and the second type image defined herein may correspond to the heavy load image described in the foregoing embodiments.

According to an exemplary embodiment, a period for displaying each fame image may comprise an image display phase and a non-display phase prior to the image display phase, and sensing the type of the image to be displayed may be executed during the non-display phase. For example, in the non-display phase, the power circuit may adjust the potential of part of the common electrodes in the display panel according to the sensing signal from the sensing circuit, preparing for displaying the image.

To sum up, for the exemplary embodiments provided in the disclosure, by judging the type of the image to be displayed by the display panel, it can be determined whether the image to be displayed is a light load image or a heavy load image, and potentials of some of the common electrodes in the display panel are controlled based on the judgement. For example, when it is determined that the image to be displayed is a heavy load image, the potentials of some of the common electrodes are increased or decreased such that the voltage differences between the pixel electrodes in the entire display area of the display panel and the common electrodes tend to be consistent, or the difference in the voltage differences between the pixel electrodes in different sub-display areas of the display panel and the common electrodes can at least be reduced, which helps to mitigate the brightness unevenness in the image displayed by the display panel.

The person having ordinary skill in the art can understand that, all or part of the steps for implementing the above method embodiments may be accomplished by means of a program instructing related hardware, and the program may be stored in a computer-readable storage medium and execute, when being run, steps involved in the above method embodiments, The computer-readable storage medium may comprises various mediums capable of storing program codes, such as ROM, RAM, magnetic disc or optical disc.

What have been stated above is only some specific exemplary embodiments, but the protection scope of the present application should not be limited thereto. Any variation or substitution easily conceivable within the spirit revealed in the disclosure for a skilled person familiar with this technical field shall fall within the protection scope of the present application. Therefore, the protection scope of the application shall be subject to the appended claims.

The invention claimed is:

1. A display panel, comprising:

a plurality of common electrodes in a display area of the display panel, the display area at least comprising a first sub-display area and a second sub-display area, and a power circuit configured to drive the plurality of common electrodes, wherein the plurality of common electrodes at least comprise a first common electrode in the first sub-display area and a second common electrode in the second sub-display area, the first common electrode and the second common electrode are insulated from each other, wherein the power circuit comprises a sensing circuit and a voltage output circuit, the sensing circuit is configured to provide a sensing signal, the sensing signal being indicative of a type of an image to be displayed by the display panel;

the voltage output circuit is electrically connected to one of the first common electrode and the second common electrode, the voltage output circuit is configured to receive the sensing signal and change a potential of the one of the first common electrode and the second common electrode in response to a change in the sensing signal, wherein the type of the image to be displayed comprises a heavy load image and a light load image, wherein the sensing circuit comprises a current detecting circuit, and the current detecting circuit is configured to sense an operation current of the display panel, a change in the operation current reflecting a change in the type of the image to be displayed by the display panel, wherein the current detecting circuit comprises a comparison circuit, the comparison circuit is configured to compare the operation current with a reference current to generate the sensing signal, wherein the comparison circuit comprises a comparator, an input terminal of the comparator is configured to receive an internal DC operation voltage of the display panel, a second terminal of the comparator is electrically connected to a reference voltage terminal, and an output terminal of the comparator is electrically connected to the first input terminal and configured to output the sensing signal.

2. The display panel according to claim 1, wherein the display panel further comprises a plurality of data lines and a source driver in a non-display area of the display panel, the plurality of data lines comprise a first data line extending from the source driver to the first sub-display area and a second data line extending from the source driver to the second sub-display area, wherein a length of the first data line is different from a length of the second data line, and the first sub-display area and the second sub-display area are arranged in a direction perpendicular to an extending direction of the plurality of data lines in the display area.

3. The display panel according to claim 2, wherein the source driver is located in a central part of an edge of the display panel, and the first sub-display area comprises a central area of the display area, lines from the first common electrode in the central area to the central part of the edge are substantially perpendicular to the edge.

4. The display panel according to claim 3, wherein the voltage output circuit comprises a first voltage output sub-circuit and a second voltage output sub-circuit, the first voltage output sub-circuit is configured to output a first voltage in response to receipt of the sensing signal of a first level, and the second voltage output sub-circuit is configured to output a second voltage different from the first voltage in response to receipt of the sensing signal of a second level, wherein one of the first common electrode and the second common electrode is electrically connected with the first voltage output sub-circuit and the second voltage output sub-circuit to receive the first voltage or the second voltage, and the other of the first common electrode and the second common electrode is configured to be electrically connected to a fixed potential terminal having the first voltage or the second voltage.

5. A method for driving the display panel according to claim 1 comprising:

sensing a type of an image to be displayed by the display panel;

changing a potential of one of the first common electrode and the second common electrode in response to a change in the type of the image to be displayed.

6. The method according to claim 5, wherein the image to be displayed comprises a first type image and a second type image, wherein a number of pulses within an unit time period of a first data signal for displaying the first type image is not greater than a first threshold, and a number of pulses within the unit time period of a second data signal for displaying the second type image is greater than the first threshold, wherein the method comprise:

providing a same potential to the first common electrode and the second common electrode in response to the display panel displaying the first type image, and changing the potential of the one of the first common electrode and the second common electrode in response to the display panel displaying the second type image.

7. The display panel according to claim 1, wherein the voltage output circuit comprises a first voltage output sub-circuit and a second voltage output sub-circuit, the first voltage output sub-circuit is configured to output a first voltage in response to receipt of the sensing signal of a first level, and the second voltage output sub-circuit is configured to output a second voltage different from the first voltage in response to receipt of the sensing signal of a second level.

8. The display panel according to claim 7, wherein the first voltage output sub-circuit comprises a first transistor, a control terminal of the first transistor is electrically connected to the output terminal of the sensing circuit to receive the sensing signal, a first terminal of the first transistor is electrically connected to a first voltage terminal, the first voltage terminal is configured to provide the first voltage, and a second terminal of the first transistor is configured to output the first voltage, wherein the second voltage output sub-circuit comprises a second transistor, a control terminal of the second transistor is electrically connected to the output terminal of the sensing circuit to receive the sensing signal, a first terminal of the second transistor is electrically connected to a second voltage terminal, the second voltage terminal is configured to provide the second voltage, and a second terminal of the second transistor is configured to output the second voltage.

9. The display panel according to claim 8, wherein the first transistor comprises one of an N-type transistor and a P-type transistor, and the second transistor comprises the other of the N-type transistor and the P-type transistor.

* * * * *